US005749704A

United States Patent [19]

Jerdee

[11] Patent Number: 5,749,704

[45] Date of Patent: May 12, 1998

[54] HEAT GUN FAN ASSEMBLY

[75] Inventor: Jeffrey S. Jerdee, Brooklyn Center, Minn.

[73] Assignee: Wagner Spray Tech Corporation, Minneapolis, Minn.

[21] Appl. No.: 779,323

[22] Filed: Jan. 6, 1997

[51] Int. Cl.[6] ..... F01D 1/02

[52] U.S. Cl. ..... 415/211.2; 415/219.1; 415/220; 219/370; 310/58

[58] Field of Search ..... 415/211.2, 219.1, 415/220, 176; 219/370; 310/60 R, 60 A, 58, 59; 392/285; 34/97

[56] References Cited

U.S. PATENT DOCUMENTS

| | | | |
|---|---|---|---|
| 3,670,190 | 6/1972 | Goebel | 310/60 R |
| 4,039,774 | 8/1977 | Kata et al. | 219/370 |
| 4,309,595 | 1/1982 | Long et al. | 34/97 |
| 4,596,921 | 6/1986 | Hersh et al. | 219/370 |
| 4,683,370 | 7/1987 | Peterson et al. | 219/370 |
| 4,972,065 | 11/1990 | Ohlsen | 34/97 |
| 5,349,161 | 9/1994 | Bockholt | 219/385 |

*Primary Examiner*—Thomas E. Denion
*Attorney, Agent, or Firm*—Faegre & Benson

[57] ABSTRACT

A heat gun having a fan assembly for use therein having a flow straightener to reduce turbulence in air passing through the fan assembly. The fan assembly also includes a blower housing with a reduced diameter outlet, a relatively large diameter radial flow impeller, and an electric motor to rotate the impeller. The flow straightener includes a plurality of vanes, and curved radially interior and exterior walls. The motor includes apertures in upstream and downstream ends and apertures in a cylindrical sidewall.

20 Claims, 4 Drawing Sheets

HEAT GUN FAN ASSEMBLY

TECHNICAL FIELD

The present invention is in the field of fan subassemblies for heat guns of the type useful in removal of paint and similar coatings. More specifically, the present invention is directed to a heat gun fan assembly of the type having a flow straightener.

BACKGROUND OF THE INVENTION

Numerous heat gun designs exist in the prior art. Such prior art designs use, in some configuration, a fan assembly enclosed in a housing with an air inlet and outlet, an impeller, and an electric motor to rotate the impeller which generates a stream of moving air.

One important feature of a heat gun of the type used to remove paint from surfaces is that it generate a high air flow rate. A number of factors affect the rate at which air flows through a heat gun fan assembly.

First, the design and size of the impeller affect air flow. At least two types of impellers are used in heat gun design: axial flow impellers and radial flow impellers. Both use a circular array of blades spinning in a plane of rotation perpendicular to the direction of air flow through the fan assembly. The blades of the impellers are generally perpendicular to the plane of rotation. However, the axial impeller pushes air in an axial direction past the impeller blades while the radial impeller has a solid disk beneath the blades in the plane of rotation so that air is initially directed radially outward by the impeller blades and then around the edge of the disk by a surrounding housing. The axial flow impeller has less ability to sustain a constant flow of air than the radial flow impeller if, downstream from the impeller, airflow is somehow restricted creating back pressure. In terms of heat gun design, implements such as a flow concentrator or scraper may be placed on an air outlet of the heat gun causing restricted flow and back pressure. To the extent that this occurs, a radial flow impeller may be preferable over an axial flow impeller. Also, generally, the larger the diameter of a radial flow impeller, the higher the velocity of air moved by the impeller. Thus, typically, the larger the diameter of a radial flow impeller, the higher the air flow rate through the fan assembly.

A second factor affecting air flow is turbulence. The less turbulence created by the fan assembly, the less motor energy is wasted in creating and sustaining the turbulence, and the more laminar flow or "blowing" air can be generated at the fan assembly outlet. One way turbulence arises is by forcing air around sharp "corners" along the air flow path. A second way is by having an open area within the fan assembly in which air flow is undirected by any structure.

A third factor affecting air flow rate is the power output of the motor. Generally, the greater the power output of the motor, the more air can be moved through the fan housing in a given amount of time. Further, the more heat that can be drawn away from the motor, the more power that can be drawn from the motor. Thus, to the degree possible, it is advantageous to use the pressurized air flow created by the impeller to draw heat away from the motor.

Apart from air flow rate, another important feature of heat gun design, from a customer expectations standpoint, is that a barrel of the heat gun, downstream from the impeller, be of a diameter that is small enough to allow ease of handling. This means that it is generally desirable to have an outlet of the fan assembly also be of a relatively small diameter so that it matches the diameter of the barrel.

This requirement, however, can be at odds with the need for a high air flow rate through the fan assembly. As discussed above, it is advantageous to use a relatively large diameter, radial flow impeller in fan assembly design. However, this means that the diameter of the fan assembly housing must decrease from the impeller region to the outlet of the housing if the barrel of the heat gun is not to be oversized. This, in turn, means that downstream airflow must first be directed radially inward from the from the point it leaves the impeller and then redirected axially downstream before exiting the fan assembly. Achieving such redirection increases the possibility that the moving air will become turbulent inside the fan assembly at sharp corners or open areas.

Fan assemblies of the prior art address these factors to varying degrees. A radial flow fan assembly 11 of the prior art is shown in FIG. 1. Referring also to FIGS. 1*a* and 1*b*, an electric motor 19 is affixed to an upstream end of a housing 13. The motor 19 has two apertures 23 in the sidewall housing, four apertures 21 in its downstream end as shown in FIG. 1*a* (proximal to the impeller), and as shown in FIG. 1*b*, four apertures 25 in the upstream end of the motor. An impeller 17 rotated by the motor 19 in a plane perpendicular to the direction of exiting air flow 39 pulls air through an inlet 8 adjacent to the downstream end of the motor 19. The air is forced along path 9 around the impeller 17 into a plenum area 27 having flow straightener vanes 15 formed about and projecting generally radially inward of the perimeter of the plenum 27. The air is then pushed out the fan assembly 11 through a reduced diameter outlet 29.

The prior art fan assembly 11 of FIG. 1 has a relatively large diameter, radial flow impeller 17 and redirects airflow from the edges of the impeller 17 inward to the reduced diameter outlet 29. As the airflow is redirected radially inward the flow straightener vanes 15 act to decrease turbulence, however, the vanes 15 only control air flow near the perimeter of the plenum area 27. Thus, excessive turbulence may exist at the center of the plenum area 27 downstream of the impeller 17. It is believed that this results in decreased air flow through the fan assembly 11.

Also, while the motor 19 has apertures 21, 23, 25 open to ambient air, the motor 19 is positioned substantially at the exterior of the fan assembly housing, outside the path of concentrated air flow. Thus, the amount of heat drawn away from the motor 19 is limited.

An axial flow prior art heat gun fan assembly 61 is shown in FIG. 2. A cylindrical housing 63 encloses an impeller 65, flow straightener 73 and cylindrical motor 69. The impeller 65 is substantially the same diameter as the upstream opening 71 of the housing 63 and pulls air into the housing 63 and then pushes it through the flow straightener vanes 73 downstream of the impeller 65. As shown in FIG. 2*a*, the motor 69 has a plurality of holes 81 in its upstream end and, as shown in FIG. 2*b*, a plurality of holes 83 in its downstream end. While the sidewall of motor 69 also has two apertures 85, they are blocked by a cylindrical wall 70 of housing 63.

Because air passes through the fan assembly 61 of FIG. 2 in a substantially straight path, relatively little turbulence is generated. However, the use of a straight air path requires the use of a smaller impeller 65 diameter than that of the prior art fan assembly 11 of FIG. 1 to maintain a fan assembly outlet 77 diameter that is small enough to be accommodated by an appropriately sized heat gun barrel. As noted above, small impeller diameter is believed to result is a lower air flow rate.

Further, the fan assembly 61 uses an axial flow impeller 65. As discussed above, such an impeller may not sustain air flow as effectively as a radial flow impeller if airflow downstream of the impeller is constricted.

Finally, though the motor 69 is placed in the path of concentrated air flow, no mechanism is provided to direct airflow through the interior of the motor 69. The close spacing of the central section 87 of the impeller 65 to the upstream end of the motor 69 and the sharp bend that the airflow would have to take to enter the upstream end apertures 81 does not accommodate air flow into the interior of the motor 69 through the upstream end apertures 81. Also, the plastic housing sidewall 70 over the sidewall of the motor 61 covers the side apertures 85. Thus, as with the prior art fan assembly 11 of FIG. 1, the amount of heat that is drawn away from the motor 69 is limited.

SUMMARY OF THE INVENTION

Accordingly, the present invention provides a heat gun fan assembly which generates a relatively high air flow rate while also providing a relatively small diameter outlet to accommodate an appropriately sized heat gun barrel. The fan assembly uses a relatively large impeller to generate high velocity moving air, a flow straightener to direct airflow inward and then redirect air axially downstream with relatively little turbulence, and includes structure adapted to pull air through the interior of the motor to remove heat from the motor.

As such, the present invention includes a heat gun fan assembly having: a blower housing with an inlet and an outlet downstream therefrom, with a diameter of the inlet being greater than a diameter of the outlet; an electric motor with a rotatable drive shaft; an impeller attached to the drive shaft inside the blower housing adjacent to the inlet and having a diameter larger than the diameter of the blower housing outlet; and a flow straightener downstream from the impeller. The flow straightener has an upstream end, a downstream end and a curved, interior wall. The diameter of the upstream end is greater than the diameter of the downstream end so that air entering the upstream end is directed radially inward and redirected axially downstream by the curved interior wall toward the blower housing outlet. The curved interior wall acts to reduce the turbulence in the air.

In another aspect, the motor of the fan assembly of the present invention has apertures in its sidewall, upstream end, and downstream end. The sidewall apertures of the motor are positioned directly downstream from the downstream end of the flow straightener. Thus, air flows across the apertures in the sidewall of the motor such that a lower pressure region is created at the exterior of the sidewall apertures than at the interior of the motor. Thus, air is drawn into the up stream apertures of the motor, through the interior of the motor and out the sidewall apertures acting to carry heat away from the motor.

DETAILED DESCRIPTION

Figure 1:
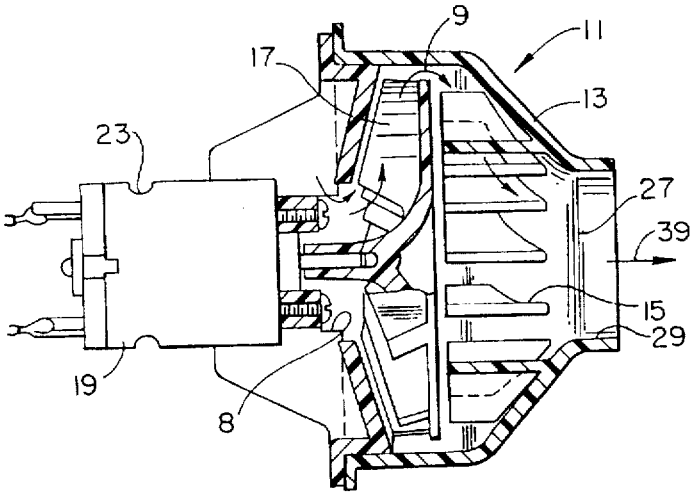
Fig.1 PRIOR ART
FIG. 1 is a simplified side elevation view of a radial flow prior art fan assembly in section.
Figure 1A:
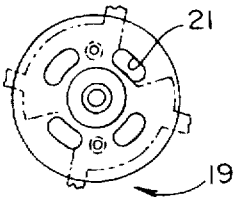
Fig.1a PRIOR ART
FIG. 1*a* is a simplified end view of the downstream end of the motor of FIG. 1.
Figure 1B:
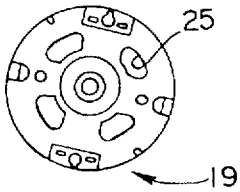
Fig.1b PRIOR ART
FIG. 1*b* is an end view of the upstream end of the motor of FIG. 1.
Figure 2:
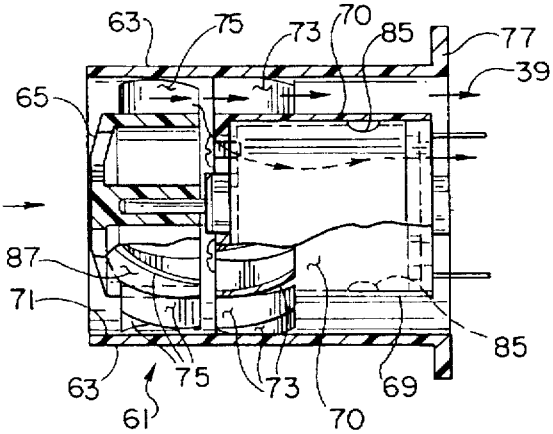
Fig.2 PRIOR ART
FIG. 2 is a simplified side elevation view in section with parts cut away of an axial flow prior art fan assembly.
Figure 2A:
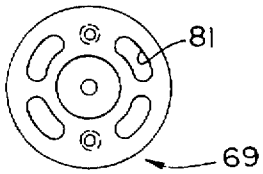
Fig.2a PRIOR ART
FIG. 2*a* is an end view of the upstream end of the motor of FIG. 2.
Figure 2B:
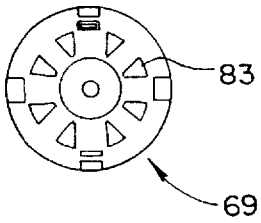
Fig.2b PRIOR ART
FIG. 2*b* is an end view of the downstream end of the motor of FIG. 2.
Figure 3:
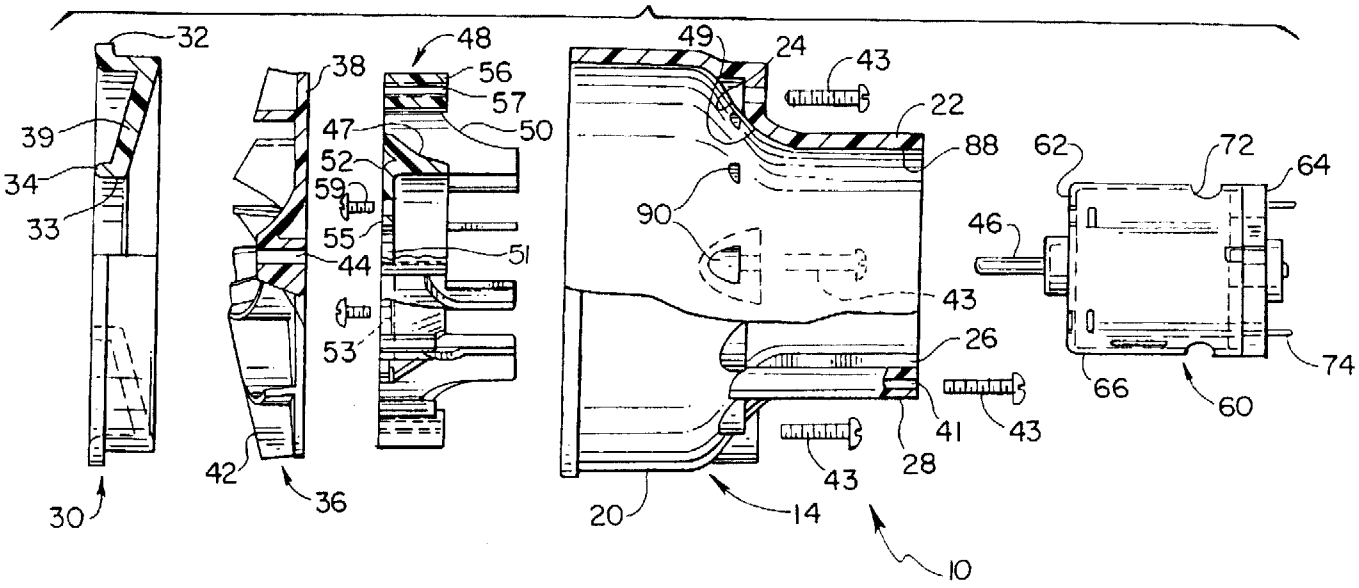
FIG. 3 is an exploded side elevational view of the fan assembly of the present invention.
Figure 6:
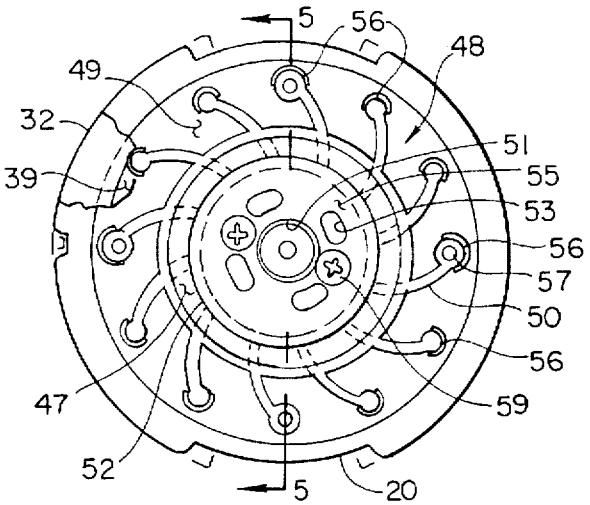
FIG. 6 is a sectional view of the fan assembly of FIG. 3 along line 6—6 of FIG. 5.
Figure 5A:
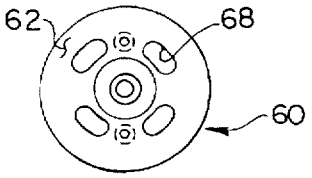
FIG. 5*a* is an end view of the downstream end of the motor of FIG. 5.
Figure 5B:
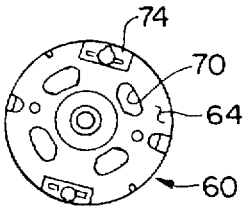
FIG. 5*b* is an end view of the upstream end of the motor of FIG. 5.
Figure 5:
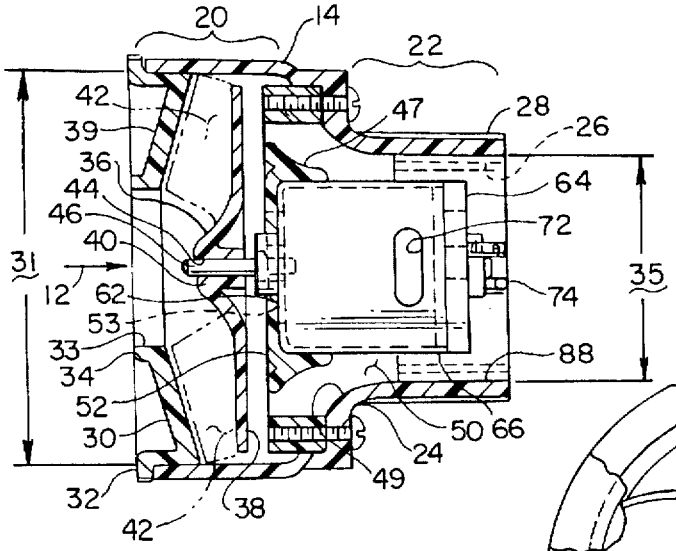
FIG. 5 is a side elevational view in section of the fan assembly of FIG. 3.
Figure 4:
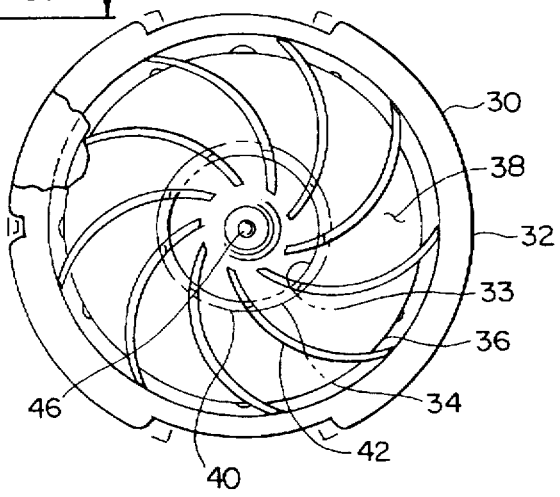
FIG. 4 is an end view of the upstream end of the fan assembly of FIG. 3.
Figures 7, 8:
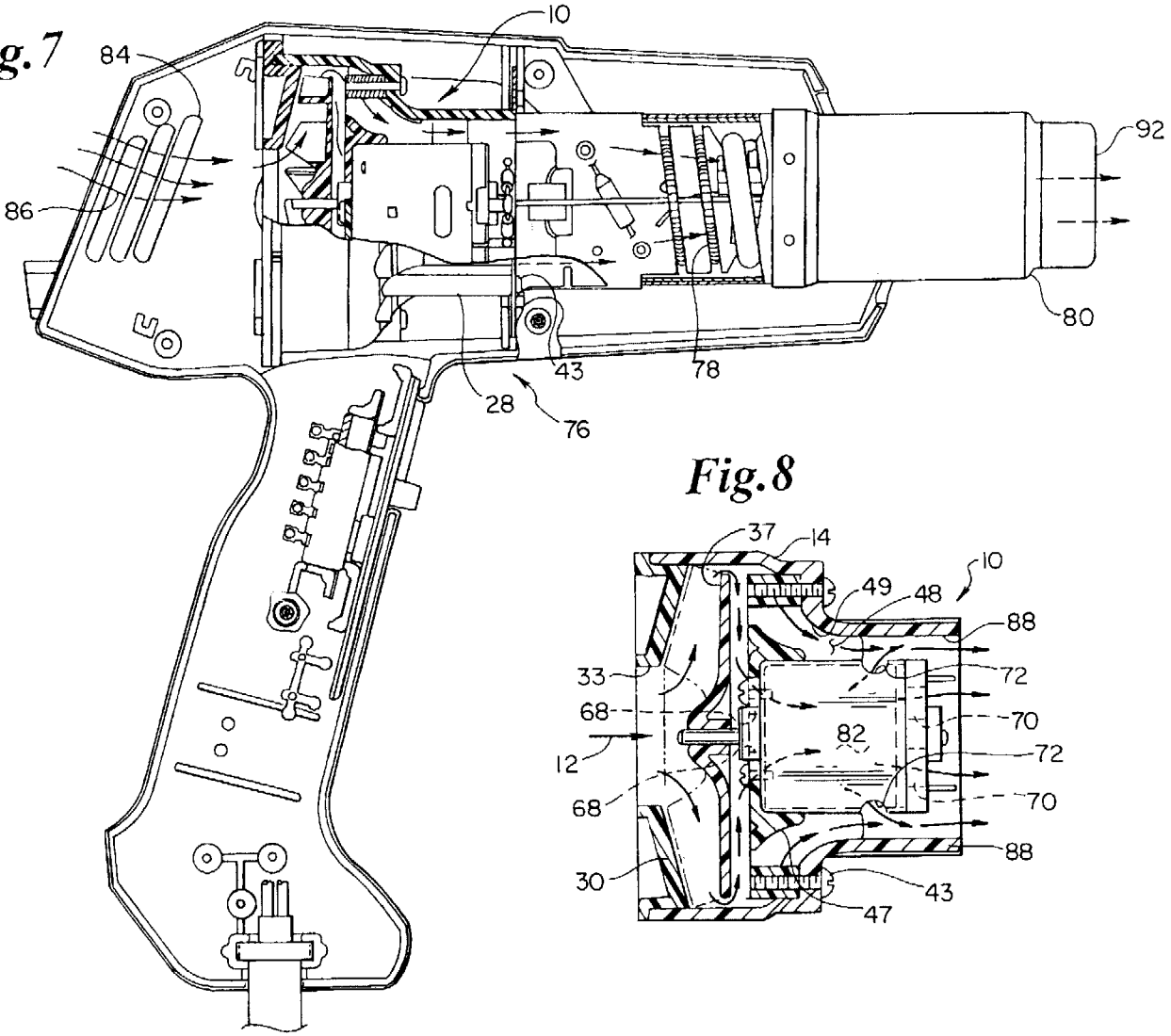
FIG. 7 is a side elevational view in section of a heat gun containing the fan assembly of FIG. 3 useful in the practice of the present invention.
FIG. 8 is a side elevational view in section of the fan assembly of FIG. 3 showing air flow paths therethrough.

Referring to FIGS. 3, 4, 5 and 6, a heat gun fan assembly 10 of the present invention is shown. Referring most particularly to FIG. 5, arrow 12 indicates the overall direction of airflow through the fan assembly 10 is axial. A generally cylindrical blower housing 14 has an upstream section 20 with a diameter 31 greater than a diameter 35 of a downstream section 22. The upstream section 20 connects with the downstream section 22 via a smooth intermediate region 24. Both the upstream section 20 and a downstream section 22 of the blower housing 14 have open bores therethrough. The downstream section 18 includes four radially projecting lateral protrusions 26 each supporting a connector shaft 28 for attachment of the blower housing 14 via a plurality of screws 43 received in mounting bores 41 to the interior of a heat gun, as shown in FIG. 7.

The upstream section 20 is adapted to receive a housing cover 30. The housing cover 30 has a substantially circular outer flange 32 and an inner lip 34 concentric with the flange 32, defining a center hole 33. Cover 30 also has a conical radial wall 39 extending from flange 32 to lip 34. Immediately downstream from the cover 30 is an impeller 36. The impeller 36 includes a radially oriented, generally flat disk 38 having a truncated conical protrusion 40 extending axially therefrom. A plurality of arcuate blades 42 protrude perpendicularly from the disk 38 towards the upstream end 20 opening of the blower housing 14. A bore 44 is formed in the center of the conical protrusion 40 and is sized for an interference press-fit with a rotating shaft 46 of a motor 60.

A flow straightener 48 is positioned downstream from the impeller 36 at the interior of the housing 14. The flow straightener 48 includes a plurality of axially aligned, arcuate vanes 50 which form axial walls of the flow straightener 48. The axial walls 50 are attached in a circular array about the exterior of a central hub 52. Hub 52 includes radially interior curved wall 47. A radially exterior curved wall 49 is formed by the intermediate region 24 of the blower housing 14. Walls 47, 49 and 50 form a plurality of smooth-walled channels for redirecting airflow leaving impeller 36, both radially inward and then axially downstream.

Hub 52 further has a radially projecting central surface 55 having a central hole 51 therein about which a plurality of smaller holes 53 are located. The central hub 52, interior wall 47 and arcuate vanes 50 of flow straightener 48 are all preferably formed integrally in a unitary molded part. Flow straightener 48 is held in place in the interior of the blower housing 14 by a plurality of cylindrical bosses 56 each located at the radially outward end of each of the plurality of arcuate vanes 50. The cylindrical bosses 56 are received in mating recesses 90 formed in the intermediate region 24 of the blower housing 14. The flow straightener 48 is preferably attached to the housing 14 via screws 43 projecting through four of the mating recesses 41 and into the hollow centers 57 of four of the cylindrical bosses 56.

Motor 60 is positioned downstream from the impeller 36 and is generally cylindrical, with an upstream end 62, a downstream end 64, and a sidewall 66. As shown in FIG. 5*a*, a plurality of apertures 68 are formed in the upstream end 62 of motor 60. As shown in FIG. 5*b*, a plurality of apertures 70 are formed in the downstream end 64 of motor 60. Referring again to FIGS. 3 and 5, two diametrically opposed apertures 72 are formed in the sidewall 66 of motor 60. The motor 60 is positioned by the flow straightener 48 in the interior of the blower housing such that the sidewall 66 is concentric with the generally cylindrical blower housing 14 and the flow straightener vanes 50 extend from the upstream end 62 of the motor axially downstream for approximately three quarters the axial length of the sidewall 66. The motor 60 is attached inside the central hub 52 via two screws 59 passing through two of the plurality of holes 53 in the radial surface 55 of the central hub 52 of flow straightener 48.

Protruding from the downstream end 64 of the motor 60 are two terminals 74. The housing 14 is preferably sized so the terminals 74 do not extend axially beyond the downstream opening 88 of the blower housing 14.

FIG. 7 shows the heat gun fan assembly 10 of the present invention installed inside a heat gun 76. As shown by the arrows 86, air flows into the heat gun 76 through a plurality of vents 84 in the side and rear of the heat gun 76. Air then flows through the fan assembly 10 as described in greater detail below. After exiting fan assembly 10, air passes across heating elements 78, through concentrator 80, and exits the heat gun 76 via nozzle 92.

FIG. 8 shows the path the air takes through the fan assembly 10. Air enters the blower housing 14 through the center hole 33 in the housing cover 30. Air is then forced radially outward by impeller 36 and is directed around the outer edge 37 of the impeller 36 and thereafter flows through the flow straightener 48. A portion of the air flows into the upstream end apertures 68 of the motor 60, through the interior 82 of the motor 60, and out of the motor 60 through either the opposed apertures 72 or the downstream end apertures 70. The flow of air coming off the impeller is directed radially inward and then axially downstream.

Flow straightener 48 of the embodiment of FIG. 8 facilitates a relatively high air flow rate through fan assembly 10 by reducing turbulence in redirecting airflow. The curved exterior wall 49 smoothly redirects radially inward air coming around the impeller outer edge 37. The curved exterior wall 49 avoids a sharp change in air flow direction as it is redirected radially inward. Most importantly, it has been found that providing the curved interior wall 47 of flow straightener 48 significantly increase airflow rate at the downstream opening 88 of the blower housing 14. It is believed that the presence of interior wall 47 increases laminar air flow through the fan assembly and decreases turbulence by smoothly redirecting the air from a radially inward direction to an axially downstream direction. As with exterior wall 49, interior wall 47 is shaped to avoid forcing a sharp turn in air flow direction.

The fan assembly 11 of the present invention also utilizes air driven by the impeller to draw heat from the interior of the motor. It is believed that redirecting the airflow first radially inward and then axially downstream so that air passes directly adjacent to the sidewall 66 of the motor 60 past the apertures 72 in the sidewall 66 increases the amount of heat drawn away from the motor. Directing high velocity airflow past the opposed apertures 72 creates a lower pressure region at the exterior of the apertures 72 than at the interior of the motor 60. Thus, air is pulled from the interior 82 of the motor 60 out the apertures 72. The end result is increased airflow through the interior 80 of the motor 60 allowing more heat to be drawn away from the motor 60.

The present invention is not to be taken as limited to all of the details of the preferred embodiments described above, as modifications and variations thereof may be made without departing from the spirit or scope of the invention.

I claim:

1. A heat gun fan assembly comprising:

a. a generally cylindrical blower housing having an interior hollow region, an inlet region at a first end thereof having a first diameter, and an outlet region having a second diameter less than the first diameter at a second end thereof downstream of the inlet;

b. an electric motor at the interior of the blower housing and having a rotatable drive shaft, a sidewall defining a motor interior and motor exterior and having a plurality of sidewall apertures, a downstream end having a plurality of downstream apertures, and an upstream end having a plurality of upstream apertures;

c. an impeller attached to the drive shaft of the motor and positioned in the interior hollow region of the blower housing and adjacent to the inlet, the impeller having a diameter greater than the diameter of the outlet region of the blower housing; and d. a flow straightener adjacent to and downstream from the impeller, the flow straightener having an upstream end, a downstream end, and a curved radially interior wall, wherein a diameter of the upstream end is greater than a diameter the downstream end such that air moved by the impeller into the upstream end of the flow straightener is directed radially inward, and redirected axially downstream by the curved interior wall of the flow straightener toward the blower housing outlet region, and further wherein the sidewall apertures of the motor are located downstream of at least a portion of the flow straightener with the result that air is forced past the sidewall apertures at the motor exterior creating a lower pressure region at the motor exterior than in the motor interior to pull air into the motor interior through the upstream apertures, and out through the downstream apertures;

such that the curved interior wall of the flow straightener decreases air turbulence in the blower housing and generates increased airflow through the interior of the motor to draw heat away from the motor.

2. The fan assembly of claim 1 wherein the blower housing further includes an intermediate region between the first end and the second end, the intermediate region forming a radially exterior curved wall of the interior hollow region of the blower housing such that air moved by the impeller into the upstream end of the flow straightener is directed radially inward by the curved exterior wall.

3. The fan assembly of claim 1 wherein the flow straightener further includes a plurality of arcuate axially-aligned vanes arranged about the interior of the blower housing adjacent to the upstream end of the motor.

4. The apparatus of claim 3 wherein the flow straightener further includes a substantially cylindrical central hub joined to the plurality of vanes at a radially interior edge of each vane, an external circular surface of the frame forming the interior curved wall of the flow straightener.

5. The apparatus of claim 1 wherein the motor is cylindrical and further wherein the downstream section of the blower housing forms a concentric cylinder radially spaced apart from and surrounding the sidewall of the motor.

6. The apparatus of claim 1 wherein the impeller is a radial flow impeller.

7. The apparatus of claim 1 further including an inlet plate having a centrally located orifice, the inlet plate positioned at the inlet of the blower housing for allowing air to flow into the interior region of the blower housing.

8. A heat gun fan assembly comprising:

a. a blower housing having an interior hollow region, an inlet at a first end thereof, an intermediate region forming a curved exterior wall of the interior hollow region, and an outlet at a second end of the housing downstream of the inlet;

b. an impeller positioned in the interior hollow region of the blower housing adjacent to the inlet and having a diameter greater than a diameter of the outlet of the blower housing;

c. a flow straightener adjacent to and downstream from the impeller, the flow straightener having an upstream end, a downstream end, and a curved radially interior wall, wherein a radial cross section of the flow straightener is circular and a diameter of a radial cross section of the upstream end is greater than a diameter of a radial cross section of the downstream end such that air moved by the impeller into the upstream end of the flow straightener is directed radially inward by the curved exterior wall of the interior of the blower housing, and redirected axially downstream by the curved interior wall of the flow straightener toward the blower housing outlet; and d. an electric motor having a sidewall defining an interior and having a plurality of sidewall apertures, a downstream end having a plurality of downstream apertures, and an upstream end having a plurality of upstream apertures, the sidewall apertures located downstream of at least a portion of the flow straightener such that the interior curved wall of the flow straightener pushes air past the sidewall apertures creating a lower pressure region at an exterior of the sidewall apertures than in the interior of the motor such that air is pulled into the upstream apertures, through the interior of the motor and out the sidewall apertures, wherein the curved interior wall of the flow straightener decreases air turbulence in the blower housing and generates increased airflow through the interior of the motor to draw heat away from the motor.

9. The apparatus of claim 8 wherein the flow straightener further includes a plurality of arcuate vanes evenly arranged in a circular pattern about the interior of the blower housing adjacent to the upstream end of the motor.

10. The apparatus of claim 8 wherein the blower housing is substantially cylindrical, and further wherein an upstream section of the blower housing has a larger diameter than a downstream section of the blower housing.

11. The apparatus of claim 8 wherein the impeller is a radial flow impeller.

12. The apparatus of claim 8 wherein the motor is cylindrical in shape and further wherein the downstream section of the blower housing forms a concentric cylinder completely surrounding and radially spaced apart from the sidewall of the motor.

13. The apparatus of claim 8 further including an inlet plate having a centrally located orifice, the inlet plate positioned at the inlet of the blower housing for allowing air to flow into the interior region of the blower housing.

14. A heat gun comprising:

a. a heat gun shell defining a cavity having an upstream end and a downstream end;

b. a blower housing having an interior hollow region, an inlet at a first end thereof, an intermediate region forming a curved exterior curved wall of the interior hollow region, and an outlet at a second end of the housing downstream of the inlet;

c. a heating means including a support and a heating element, the heating element braced by the support and disposed in the cavity of the heat gun shell downstream from the blower housing;

d. an impeller positioned in the interior hollow region of the blower housing and adjacent to the inlet, the impeller having a diameter greater than a diameter of the outlet of the blower housing;

e. a flow straightener adjacent to and downstream from the impeller, the flow straightener having an upstream end, a downstream end, and a curved radially interior wall, wherein a radial cross section of the flow straightener is circular and a diameter of a radial cross section of the upstream end is greater than a diameter of a radial cross section of the downstream end such that air moved by the impeller into the upstream end of the flow straightener is directed radially inward by the curved exterior wall of the interior of the blower housing, and redirected axially downstream by the curved interior wall of the flow straightener toward the blower housing outlet; and f. an electric motor having a sidewall defining an interior and having a plurality of sidewall apertures, a downstream end having a plurality of downstream apertures, and an upstream end having a plurality of upstream apertures, the sidewall apertures located downstream of at least a portion of the flow straightener such that the interior curved wall of the flow straightener pushes air past the sidewall apertures creating a lower pressure region at an exterior of the sidewall apertures than in the interior of the motor such that air is pulled into the upstream apertures, through the interior of the motor and out the sidewall apertures, wherein the curved radially interior wall of the flow straightener decreases air turbulence in the blower housing and generates increased airflow through the interior of the motor to draw heat away from the motor.

15. The apparatus of claim 14 wherein the flow straightener further includes a plurality of arcuate vanes arranged in a circular pattern about the interior of the blower housing adjacent to the upstream end of the motor.

16. The apparatus of claim 14 wherein the blower housing is substantially cylindrical, and further wherein an upstream section of the blower housing has a larger diameter than a downstream section of the blower housing.

17. The apparatus of claim 14 wherein the impeller is a radial flow impeller.

18. The apparatus of claim 14 wherein the motor is cylindrical in shape and further wherein the downstream section of the blower housing forms a concentric cylinder completely surrounding the sidewall of the motor.

19. The apparatus of claim 14 further including an inlet plate having a centrally located orifice, the inlet plate positioned at the open upstream end of the blower housing for allowing air to flow into the interior region of the blower housing.

20. A heat gun fan assembly comprising:

a. a blower housing having an interior hollow region, an inlet region at a first end thereof, and an outlet region at a second end thereof downstream of the inlet region;

b. an electric motor at the interior of the blower housing and having a rotatable drive shaft and a case, the case defining a motor interior and a motor exterior, the case further having at least a first aperture and at least a second aperture;

c. an impeller attached to the drive shaft of the motor; and d. a flow straightener downstream from the impeller, the flow straightener having an upstream end, a downstream end, and a radially interior wall, such that air moved by the impeller into the upstream end of the flow straightener is directed axially downstream by the interior wall of the flow straightener toward the blower housing outlet region, and further wherein the second aperture of the motor is located downstream of at least a portion of the flow straightener with the result that air is forced past the motor exterior and across the second aperture creating a lower pressure region at the motor exterior than in the motor interior to pull air into the motor interior through the first aperture and out through the second aperture;

such that the interior wall of the flow straightener generates increased airflow through the interior of the motor to draw heat away from the motor.

* * * * *